US010716378B1

(12) United States Patent
Boyer et al.

(10) Patent No.: US 10,716,378 B1
(45) Date of Patent: Jul. 21, 2020

(54) DISPOSABLE CONTAINER FOR SOLVENT CONTAMINATED WIPES

(71) Applicant: STATE FARM MUTUAL AUTOMOBILE INSURANCE COMPANY, Bloomington, IL (US)

(72) Inventors: Patrick H. Boyer, Bloomington, IL (US); John Donovan, Bloomington, IL (US); Jackie O. Jordan, II, Bloomington, IL (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 0 days.

(21) Appl. No.: 15/639,169

(22) Filed: Jun. 30, 2017

Related U.S. Application Data

(60) Provisional application No. 62/409,570, filed on Oct. 18, 2016.

(51) Int. Cl.

| | |
|---|---|
| ***A45C 11/00*** | (2006.01) |
| ***B65D 51/28*** | (2006.01) |
| ***F04B 53/10*** | (2006.01) |
| ***F04B 9/127*** | (2006.01) |
| *B65D 75/58* | (2006.01) |
| *A45D 40/22* | (2006.01) |

(52) U.S. Cl.
CPC ..... *A45C 11/008* (2013.01); *B65D 51/28* (2013.01); *F04B 9/1276* (2013.01); *F04B 53/1062* (2013.01); *A45D 2040/224* (2013.01); *B65D 75/5805* (2013.01); *B65D 2209/00* (2013.01)

(58) Field of Classification Search
CPC .. A45C 11/008; B65D 51/28; B65D 2209/00; F04B 9/1276; F04B 53/1062
USPC ..... 206/581, 204
See application file for complete search history.

(56) References Cited

U.S. PATENT DOCUMENTS

| | | | | |
|---|---|---|---|---|
| 4,786,534 | A * | 11/1988 | Aiken | A45D 40/0087 206/229 |
| 4,938,347 | A * | 7/1990 | Tillman | A45D 29/007 132/75 |
| 5,037,379 | A * | 8/1991 | Clayman | A61B 17/00234 128/849 |
| 7,290,660 | B2 * | 11/2007 | Tilman | B65B 31/04 206/524.8 |
| 2009/0190865 | A1 * | 7/2009 | Chang | A45C 3/001 383/110 |
| 2013/0266755 | A1 * | 10/2013 | Mengel | A23B 4/10 428/68 |
| 2014/0056543 | A1 * | 2/2014 | Lay | B65D 65/466 383/1 |

(Continued)

*Primary Examiner* — Steven A. Reynolds
(74) *Attorney, Agent, or Firm* — Marshall, Gerstein & Borun LLP

(57) ABSTRACT

A disposable container for solvent contaminated wipes and a method of using the disposable container to prevent solvent contaminated wipes from spontaneously combusting is disclosed. The disposable container may be a flexible bag made of a material having a solvent-resistant, non-permeable layer and optionally other layers. The disposable container has an oxygen-reduction system including an air-tight seal, which may be formed in a variety of ways, and an oxygen-removal mechanism, such as a small pump that is integral to the flexible bag or a pump outlet that can be connected to an external pump.

17 Claims, 3 Drawing Sheets

(56) References Cited

U.S. PATENT DOCUMENTS

2014/0212077 A1* 7/2014 Han ..... B65D 33/02
383/107
2018/0042318 A1* 2/2018 Jagnarine ..... A41D 19/0037

* cited by examiner

DISPOSABLE CONTAINER FOR SOLVENT CONTAMINATED WIPES

CROSS-REFERENCE TO RELATED APPLICATION

The priority benefit of U.S. Provisional Patent Application No. 62/409,570, filed Oct. 18, 2016, and entitled "Disposable Container for Solvent Contaminated Wipes," is claimed and the entire contents thereof are incorporated by reference herein.

TECHNICAL FIELD

This application relates generally to a disposable container and method of use for safely storing and/or disposing of solvent contaminated wipes that could otherwise spontaneously combust. In particular, this application is directed to a cost-effective disposable container for use by a typical homeowner that reduces oxygen from within the container in order to prevent the start of a fire.

BACKGROUND

Paper towels, cotton, fabrics, rags, or other materials used with gasoline, wood finishing solvents such as linseed oil or turpentine, or other solvents are prone to spontaneous combustion. When such solvent-coated materials are left alone or in a pile, the solvent evaporates, creating heat, which then ignites the material. "Solvent contaminated wipes" or "waste rags" are the common phrases used in the fire community to describe materials that could ignite by spontaneous combustion. Spontaneous combustion fires created by solvent contaminated wipes are a well-known cause of residential fires. According to the National Fire Protection Association, fires caused by spontaneous combustion or chemical reaction accounted for an average of 14,070 fires per year between 2005 and 2009, including 3200 structure fires. The most common occupancy types for structure fires caused by spontaneous combustion or chemical reaction were residential (50% of fires), storage (12% of fires), mercantile or business (9% of fires), and manufacturing or processing (9% of fires). Among those structure fires caused by spontaneous combustion or chemical reaction in one- and two-family homes, apartments, and manufactured housing, solvent contaminated wipes were the most common item first ignited.

Despite the common knowledge that solvent contaminated wipes result in residential fires, the products on the market to address the problem of disposing of solvent contaminated wipes are largely directed at commercial purchasers. For example, existing steel or plastic containers for storing solvent contaminated wipes generally cost between $75 and $140. These containers are difficult to locate in common consumer big box stores and are price prohibitive for the typical homeowner.

SUMMARY

Embodiments within the scope of the present disclosure are directed to the use of a disposable container having a solvent-resistant, non-permeable lining to safely dispose of solvent contaminated wipes. As a preliminary matter, in order to be widely adopted by the typical homeowner, the disposable container must be cost-effective. The disposable container should also be relatively easy to move in order to facilitate display at common big box consumer outlets and transport to a purchaser's home. The disposable container may be a flexible bag with a solvent-resistant, non-permeable liner that can be manufactured inexpensively and is easily transported.

The basic operating principle of embodiments within the scope of the present disclosure is that a fire cannot start in the absence of oxygen. Accordingly, embodiments within the scope of the present disclosure are provided with an oxygen-reduction system having an air-tight seal and an oxygen-removal mechanism. After a user puts solvent contaminated wipes in the disposable container, the disposable container is sealed with the air-tight seal. The air-tight seal may be formed by an adhesive flap integral to the disposable container being secured to the disposable container, a sticker or latch holding portions of a disposable container together, compatible portions of the disposable container being pressed together, or any other known structure or mechanism by which a disposable container may be sealed. A permanent adhesive may be used in conjunction with any mechanism sealing the disposable container in order to ensure the integrity of the air-tight seal. After the disposable container is sealed, air is removed from the bag via an oxygen-removal mechanism. For example, in some embodiments, a small pump is integral to the disposable container and removes air from disposable container. In other embodiments, the disposable container has a pump outlet that can be joined to an external pump to remove air from the flexible bag.

The oxygen-reduction system may optionally further include an indicator that informs the user when a sufficient amount of oxygen has been removed from the bag. For example, if the disposable container is a flexible bag, the indicator may include an LED light that is activated by a button. The indicator may be located at a central part of one side of the flexible bag with the LED light facing outside the bag and the button facing inside the bag. As air is removed from the flexible bag, the flexible bag will slowly become compressed and exert an increasing amount of pressure on the button, ultimately activating the LED light. Because the amount of pressure on the button corresponds with the amount of oxygen removed from the bag, the indicator can be designed such that the button activates the LED light when a sufficient amount of oxygen has been removed from the bag to prevent the solvent contaminated wipes contained within the bag from spontaneously combusting. The LED light thus signals to the user that further oxygen removal is unnecessary and the user may safely dispose of the disposable container.

Embodiments within the scope of the present disclosure may range in size considerably. The Environmental Protection Agency and state and local regulations govern the quantity of solvent contaminated wipes that may be discarded, and the disposable container can be a variety of sizes in order to comply with these regulations. In some embodiments, the disposable container may be a half gallon or larger flexible bag. In some embodiments, the disposable container may be designed to hold a specific number of solvent contaminated wipes. Because the disposable container will be discarded with other trash, the disposable container must not puncture easily. If the disposable container is punctured, at least some oxygen can enter the disposable container and spontaneous combustion is more likely. Accordingly, in some embodiments in which the disposable container is a flexible bag, the material forming the flexible bag is thicker than a minimum material thickness necessary to prevent the bag from being punctured. In other embodiments, the disposable container is made of a material that is not easily punctured. Additionally, in some embodiments, the disposable container includes insulation to ensure that any heat generated by the solvent contaminated wipes within the disposable container remains in the disposable container and is not transferred to neighboring items or refuse.

In some embodiments within the scope of the present disclosure, the disposable container has a number of layers of material. For example, in some embodiments, the disposable container may include a solvent-resistant, non-permeable interior layer and a fire-resistant exterior layer. In some embodiments within the scope of the present disclosure, the disposable container may include a puncture-preventative layer and/or an insulation layer. Each layer may be formed of a distinct material. Alternately, some layers may be formed of a single material that serves multiple purposes. For example, the solvent-resistant, non-permeable layer and the insulation layer may be one and the same because a particular material achieves both the objective of being resistant and non-permeable to the solvent used on the solvent contaminated wipes and the objective of insulating the bag.

To use the disposable bag, the solvent contaminated wipes should first be placed in the disposable bag. The bag should not be overfilled with solvent contaminated wipes as overfilling may result in an inability of the bag to seal properly. After the bag has been filled with solvent contaminated wipes, the bag should be sealed by, for example, adhering an adhesive flap of the disposable container to the disposable container, using a sticker or latch to sealingly hold portions of the disposable container together, pressing together compatible portions of the disposable container, or by performing any other action necessary to seal the bag. The sealing of the bag may include using a permanent adhesive to ensure the integrity of the air-tight seal. After sealing the disposable container, air should be removed from the disposable container by, for example, pumping air out of the disposable container using a small integral pump or a separate pump attached to a pump outlet of the disposable container. If the disposable container has an indicator, air should be pumped out of the disposable container until the indictor indicates that a sufficient amount of oxygen has been removed for the disposable container to be safely discarded. If the disposable container does not have an indicator, a simple visual inspection of how compressed the flexible bag has become suffices to determine whether a sufficient amount of oxygen has been removed. The disposable container may then be discarded.

Also contemplated within the scope of this disclosure is a system for discarding solvent contaminated wipes. The system includes a plurality of disposable containers. The plurality of disposable containers may include one or more disposable container having an adhesive flap integral to the disposable container for forming an air-tight seal, one or more disposable container having a sticker or latch for holding portions of the disposable container together in an air-tight seal, one or more disposable container having compatible portions that can be pressed together to form an air-tight seal, and/or one or more disposable container with some other mechanisms for creating an air-tight seal. The plurality of disposable containers may each include one or more disposable container having a small integral pump and/or one or more disposable container having a pump outlet. In systems in which at least one disposable container of the plurality of disposable containers is provided with a pump outlet, the system may further include a separate pump configured to attach to the pump outlet of each disposable container having a pump outlet. The system may include a permanent adhesive that can be applied to the plurality of disposable containers. One or more of the plurality of disposable containers may be provided with an indicator that indicates when a sufficient amount of oxygen has been removed from the flexible bag to prevent spontaneous combustion.

BRIEF DESCRIPTION OF THE DRAWINGS

While the specification concludes with claims particularly pointing out and distinctly claiming the subject matter that is regarded as the present disclosure, it is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION

Figure 1:
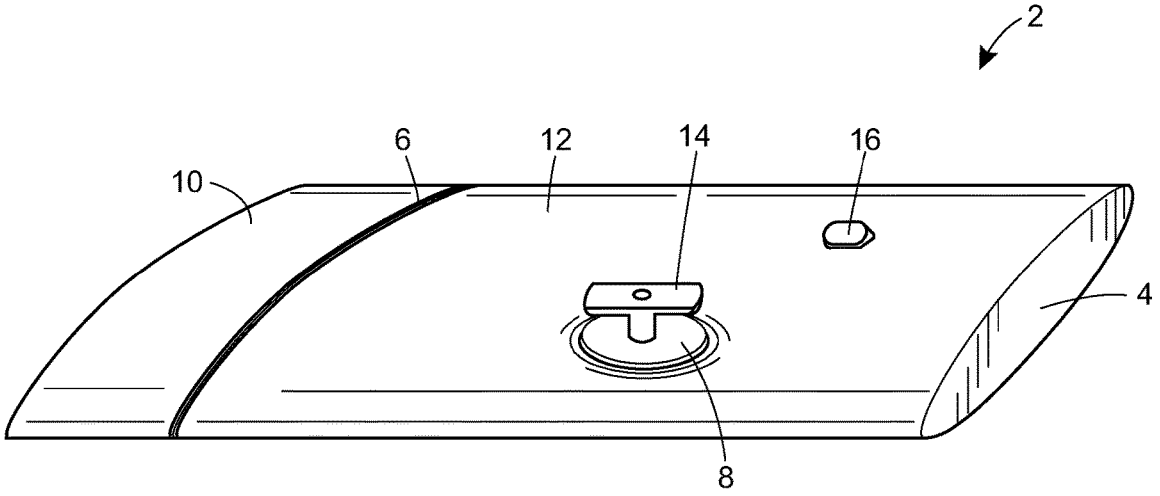
FIG. 1 illustrates a perspective view of a disposable container constructed according to the present disclosure, wherein the disposable container is a flexible bag having an airtight seal created by an adhesive flap and the flexible bag includes a small pump integral to the flexible bag to remove oxygen from the bag and an indicator.

Referring to the figures in detail, FIG. 1 illustrates an exemplary disposable container 2. In this embodiment, the disposable container 2 includes a flexible bag 4. The flexible bag 4 can come in a variety of sizes to accommodate various regulations regarding the disposal of solvent contaminated wipes and may be designated as capable of holding a set volume (i.e., one half gallon) or capable of holding a set number of solvent contaminated wipes (i.e., thirty solvent contaminated wipes that are 12 inches by 12 inches or less). The disposable container 2 has an oxygen-reduction system having an air-tight seal 6 and an oxygen-removal mechanism 8. In the embodiment depicted in FIG. 1, the air-tight seal is achieved by sticking an adhesive flap 10 to a side 12 of the flexible bag 4 and the oxygen-removal mechanism 8 is a small pump 14 integral to the flexible bag 4. In addition, the embodiment depicted in FIG. 1 has an indicator 16 that informs a person using the oxygen-reduction mechanism 8 when a sufficient amount of air has been removed from the flexible bag 4 to prevent solvent contaminated wipes put into the flexible bag 4 from spontaneously combusting. The indicator 16 depicted in FIG. 1 is an LED light located adjacent the exterior of side 12 of the flexible bag 4 with a button attached to the LED light and located adjacent the interior of side 12 of the flexible bag 4. The flexible bag 4 becomes compressed as air is removed vi the oxygen-removal mechanism 8 and the button on the interior of side 12 of the flexible bag 4 is pressed by the solvent contaminated wipes or another portion of the flexible bag 4. The indicator 16 is designed so that the button activates the LED light when, based on the degree to which the flexible bag 4 is compressed, enough oxygen has been removed from the flexible bag 4 to ensure that the solvent contaminated wipes will not spontaneously combust. Once the LED light is activated, a user knows that no more oxygen needs to be removed from the flexible bag 4 through the oxygen-reduction mechanism 8 and the disposable container 2 can be safely discarded.

Figure 2:
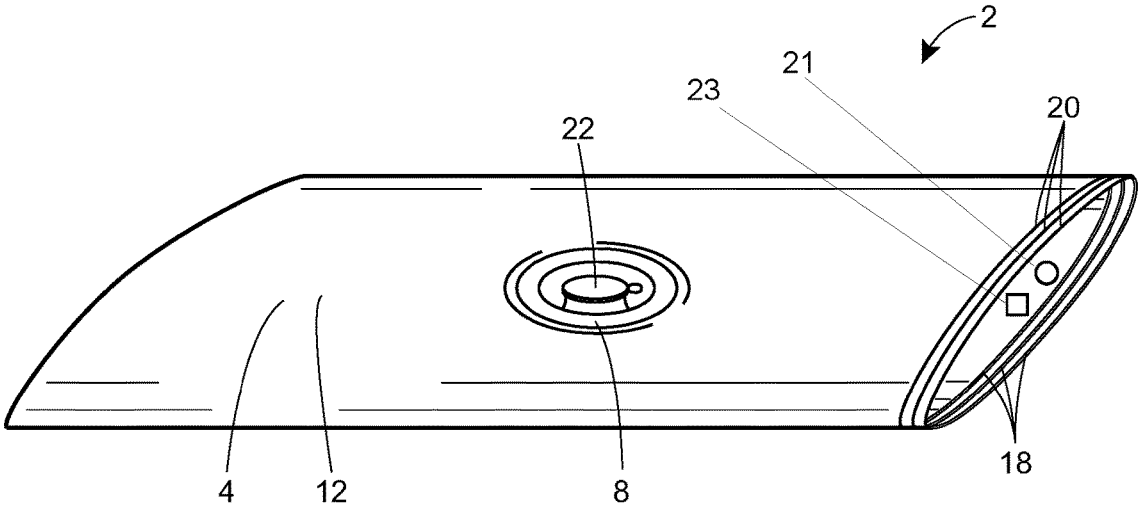
FIG. 2 illustrates a perspective view of a disposable container constructed according to the present disclosure, wherein the disposable container is a flexible bag having an airtight seal created by compatible portions of the disposable container being pressed together and the flexible bag includes a pump outlet that can be joined to an external pump to remove air from the flexible bag.

FIG. 2 likewise depicts a disposable container 2 that includes a flexible bag 4 and an oxygen-reduction system including an air-tight seal 6 (not shown as flexible bag 4 is depicted in open position) and an oxygen-removal mechanism 8. However, in the embodiment depicted in FIG. 2, the air-tight seal 6 is achieved by a set of first compatible portions 18 of the flexible bag 4 being pressed together with a set of second compatible portions 20. In other embodiments not herein depicted, the air-tight seal may be formed by a sticker 21 or a latching mechanism 23 holding portions of the disposable container together or by any other structure or mechanism. A permanent adhesive 23 may be used in conjunction with any mechanism sealing the disposable container 2 in order to ensure the integrity of the air-tight seal 6. Additionally, in the embodiment depicted in FIG. 2, the oxygen-removal mechanism 8 is a pump outlet 22 that allows an external pump to be connected to the flexible bag 4 and provides a seal when the external pump is disconnected. The embodiment depicted in FIG. 2 does not have an indicator but a user may determine that a sufficient amount of air has been removed from the flexible bag 4 by visually determining how compressed the flexible bag 4 has become.

Figure 3:
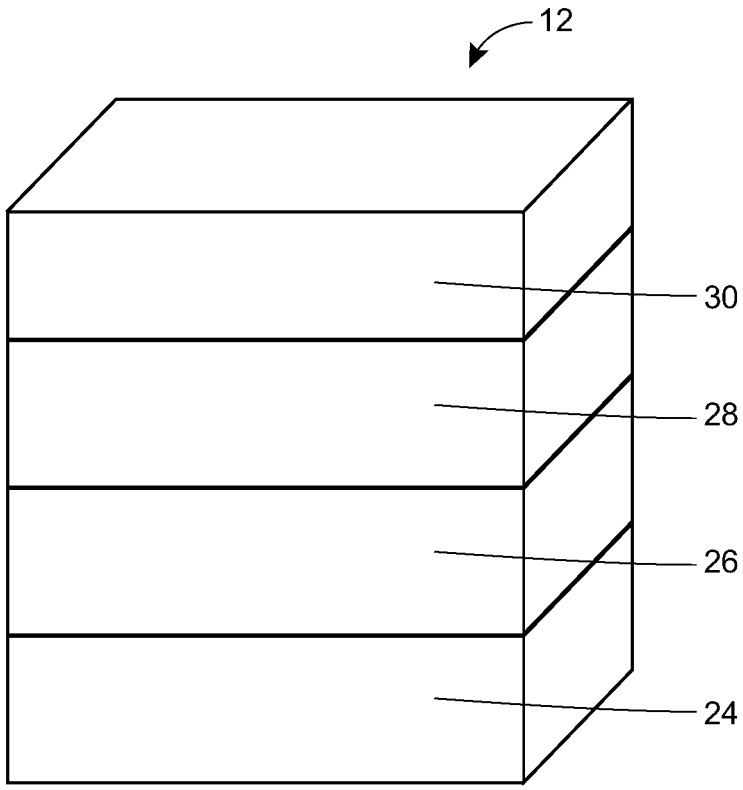
FIG. 3 illustrates a cross-sectional view of a side of a disposable container constructed according to the present disclosure, wherein the disposable container is a flexible bag having four layers of material, an interior layer being a solvent-resistant, non-permeable material, a second layer being an insulating material, a third layer being a fire-resistant material, and an exterior layer being a puncture-preventative material.
Figure 4:
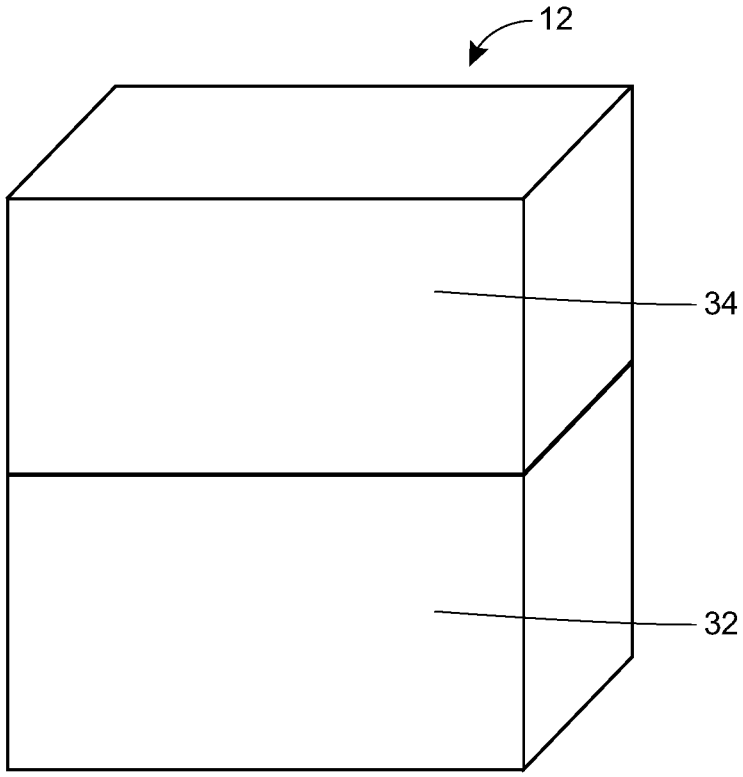
FIG. 4 illustrates a cross-sectional view of a side of a disposable container constructed according to the present disclosure, wherein the disposable container is a flexible bag having two layers of material, an interior layer being a solvent-resistant, non-permeable, and fire-resistant material, and an external layer being an insulating and puncture-preventative material.

FIG. 3 illustrates an exemplary cross-sectional view of a portion of a side 12 of a flexible bag 4 having a solvent-resistant and non-permeable layer 24, an insulating layer 26, a fire-resistant layer 28, and a puncture-preventative layer 30. In the embodiment depicted in FIG. 3, the solvent-resistant and non-permeable layer is located on the interior portion of the side 12 of the flexible bag 4, the insulating layer 26 is a second layer, the fire-resistant layer 28 is a third layer, and the puncture-preventative layer 30 is the outermost layer. However, in other embodiments, the order of the layers may be different. Further, as depicted in FIG. 4, the side 12 of a flexible bag 4 may not have all layers previously discussed or certain layers may be combined. For example, in FIG. 4, the interior layer 32 is a material having both solvent-resistant and non-permeable and fire-resistant properties, while the exterior layer 34 is puncture-preventative. In addition, other layers having properties not herein discussed may be included.

Figure 5:
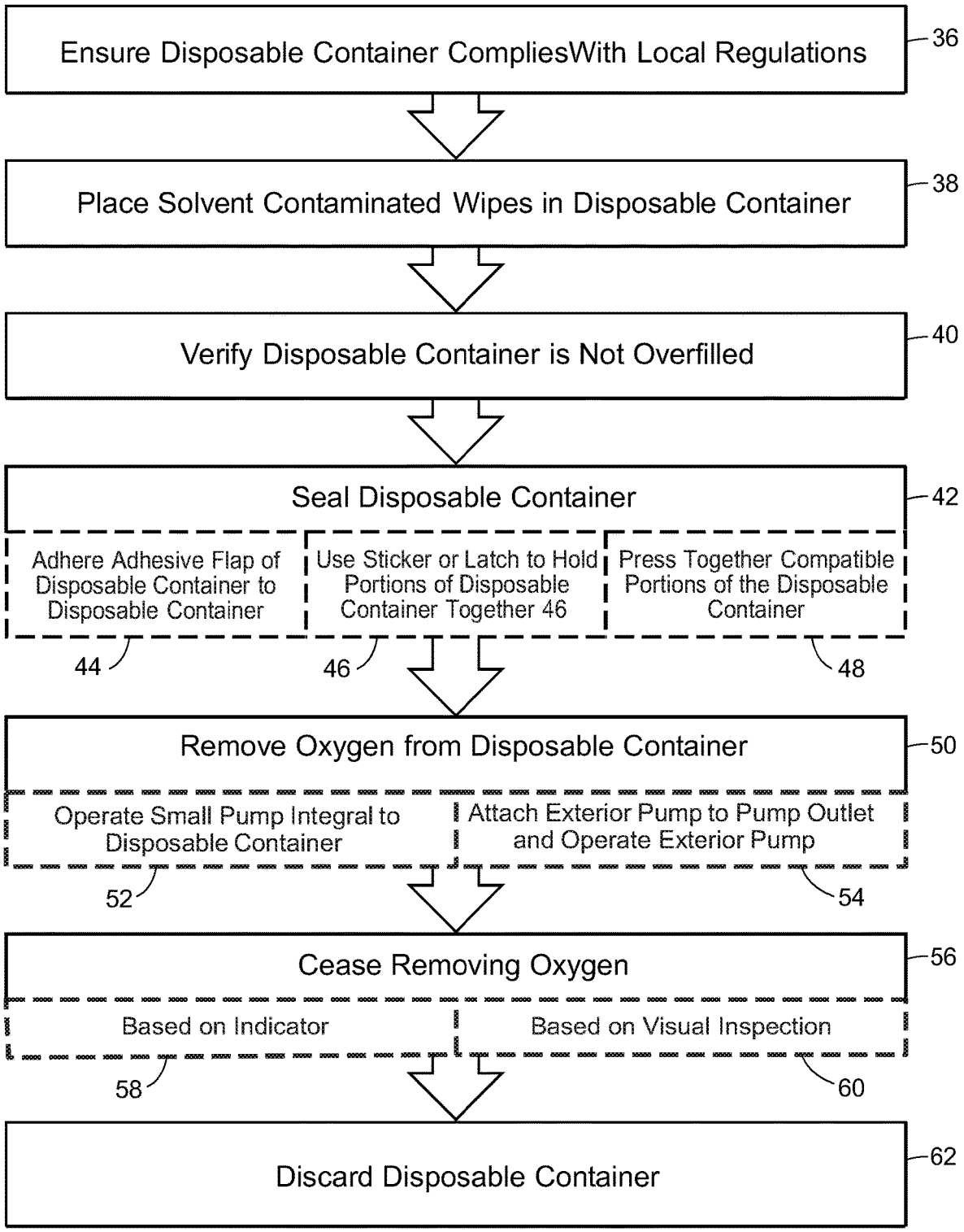
FIG. 5 illustrates schematically a method of using a disposable container constructed according to the present disclosure.

FIG. 5 illustrates an exemplary method of using an embodiment of the disposable container 2, such as those embodiments depicted in FIGS. 1 and 2. As shown in FIG. 5, the method 64 may include: ensuring a disposable container 2 for solvent contaminated wipes complies with local regulations (block 36); placing solvent contaminated wipes in the disposable container 2 (block 38); verifying that the disposable container 2 is not overfilled (block 40); sealing the disposable container 2 (block 42), which may be accomplished by adhering an adhesive flap 10 of the disposable container 2 to the disposable container 2 (block 44), using a sticker or latch to sealingly hold portions of the disposable container 2 together (block 46), pressing together first compatible portions 18 and second compatible portions 20 (block 48), or another action; removing oxygen from the disposable container 2 through use of an oxygen removal mechanism 8 (block 50), which may involve operating a small pump 14 integral to the disposable container 2 (block 52) or securing a pump outlet 22 to an exterior pump and operating the exterior pump (block 54); ceasing to remove oxygen (block 56) based on feedback from an indicator 16 (block 58) or from a visual inspection (block 60); and discarding the disposable container 2 (block 62). All of the steps listed above may be included in the method 64 or only some steps may be included.

The patent claims at the end of this patent application are not intended to be construed under 35 U.S.C. § 112(f) unless traditional means-plus-function language is expressly recited, such as "means for" or "step for" language being explicitly recited in the claim(s).

The invention claimed is:

1. A disposable container for solvent contaminated wipes comprising:

a flexible bag comprising:

a solvent-resistant, non-permeable interior layer composed of a first material, an insulating layer adjacent to the solvent-resistant, non-permeable interior layer, wherein the insulating layer is composed of a second material, a fire-resistant layer adjacent to the insulating layer, wherein the fire-resistant layer is composed of a third material, and a puncture-preventative exterior layer adjacent to the fire-resistant layer, wherein the puncture-preventative exterior layer is composed of a fourth material; and an oxygen-reduction system including an oxygen-removal mechanism and an air-tight seal.

2. The disposable container of claim 1, further comprising an adhesive flap integral to the disposable container that is pressed against a portion of the disposable container to form the air-tight seal.

3. The disposable container of claim 1, further comprising a sticker or latch that holds portions of the disposable container together to form the air-tight seal.

4. The disposable container of claim 1, further comprising compatible portions of the disposable container configured to be pressed together to form the air-tight seal.

5. The disposable container of claim 1, wherein the oxygen-removal mechanism is a pump formed integrally with the flexible bag.

6. The disposable container of claim 1, wherein the oxygen-removal mechanism is a pump outlet configured to connect to an external pump.

7. The disposable container of claim 1, wherein the oxygen-reduction system further includes an indicator that indicates when a sufficient amount of oxygen has been removed from the flexible bag to prevent spontaneous combustion.

8. The disposable container of claim 7, wherein the indicator includes an LED light.

9. The disposable container of claim 1, further comprising a permanent adhesive applied to the air-tight seal.

10. A system for discarding solvent contaminated wipes comprising:

a plurality of disposable containers, each disposable container having:

a flexible bag comprising:

a solvent-resistant, non-permeable interior layer composed of a first material, an insulating layer adjacent to the solvent-resistant, non-permeable interior layer, wherein the insulating layer is composed of a second material, a fire-resistant layer adjacent to the insulating layer, wherein the fire-resistant layer is composed of a third material, and a puncture-preventative exterior layer adjacent to the fire-resistant layer, wherein the puncture-preventative exterior layer is composed of a fourth material; and an oxygen-reduction system including an oxygen-removal mechanism and an air-tight seal;

wherein the oxygen-removal mechanism of each of the plurality of disposable containers is either a pump formed integrally with the flexible bag or a separate pump included in the system.

11. The system of claim 10, further comprising a permanent adhesive that can be applied to the plurality of disposable containers to form the air-tight seal.

12. The system of claim 10, wherein at least one of the plurality of disposable containers includes an adhesive flap integral to the disposable container that is pressed against a portion of the disposable container to form the air-tight seal.

13. The system of claim 10, wherein at least one of the plurality of disposable containers includes compatible portions of the disposable container configured to be pressed together to form the air-tight seal.

14. The system of claim 10, wherein the oxygen-removal mechanism of at least one of the plurality of disposable containers is a pump formed integrally with the flexible bag.

15. The system of claim 10, wherein:

the oxygen-removal mechanism of at least one of the plurality of disposable containers is a pump outlet configured to connect to an external pump; and the system includes a separate pump.

16. The system of claim 15, wherein the separate pump is configured to attach to the pump outlet of each of the at least one of the plurality of disposable containers having a pump outlet.

17. The system of claim 10, wherein the oxygen-reduction system of at least one of the plurality of disposable containers further includes an indicator that indicates when a sufficient amount of oxygen has been removed from the flexible bag to prevent spontaneous combustion.

* * * * *